US008347528B1

(12) United States Patent
Seltzer

(10) Patent No.: US 8,347,528 B1
(45) Date of Patent: Jan. 8, 2013

(54) SURFACE RAKE APPARATUS

(76) Inventor: Richard E. Seltzer, Centreville, MD (US)

( * ) Notice: Subject to any disclaimer, the term of this patent is extended or adjusted under 35 U.S.C. 154(b) by 140 days.

(21) Appl. No.: 12/908,087

(22) Filed: Oct. 20, 2010

(51) Int. Cl.
*E01H 5/02* (2006.01)

(52) U.S. Cl. ..... 37/265; 172/371; 56/400.15; 294/54.5

(58) Field of Classification Search ..... 37/265, 37/316; 294/54.5, 59, 176; 56/400.04, 400.15; D8/10; 172/376, 377, 371
See application file for complete search history.

(56) References Cited

U.S. PATENT DOCUMENTS

| | | | | | |
|---|---|---|---|---|---|
| 323,730 | A | * | 8/1885 | Phillips | 37/266 |
| 543,266 | A | * | 7/1895 | Parcells | 172/376 |
| 543,910 | A | * | 8/1895 | Torr | 294/54.5 |
| 568,143 | A | * | 9/1896 | Parcells | 172/376 |
| 827,542 | A | * | 7/1906 | Lawson | 56/400.04 |
| 1,144,891 | A | * | 6/1915 | Cannon | 15/245.1 |
| 1,572,824 | A | * | 2/1926 | Tatge | 37/283 |
| 1,839,285 | A | * | 1/1932 | Winkie | 294/54.5 |
| 2,710,465 | A | * | 6/1955 | Timerson | 37/268 |
| 3,091,790 | A | | 6/1963 | Schroeder | |
| D214,636 | S | * | 7/1969 | Zahler | D8/10 |
| D242,761 | S | * | 12/1976 | DiCarlo | D8/10 |
| 4,094,543 | A | * | 6/1978 | Fratini | 294/54.5 |
| 4,669,206 | A | * | 6/1987 | Yost | 37/285 |
| 4,865,373 | A | * | 9/1989 | Hudson | 294/54.5 |
| 5,450,713 | A | * | 9/1995 | Rohde et al. | 56/8 |
| 5,465,510 | A | | 11/1995 | Goodnough et al. | |
| 5,522,629 | A | * | 6/1996 | Loo | 294/51 |
| 5,676,413 | A | * | 10/1997 | Hauck | 294/54.5 |
| 5,791,707 | A | | 8/1998 | Szakurski | |
| D407,723 | S | * | 4/1999 | Weisman et al. | D15/11 |
| 6,092,315 | A | | 7/2000 | Katauskas | |
| 6,202,329 | B1 | | 3/2001 | Supplee et al. | |
| 7,707,679 | B2 | * | 5/2010 | Young | 15/245 |
| 8,100,447 | B2 | * | 1/2012 | DeWinter | 294/51 |
| D656,162 | S | * | 3/2012 | Wiik | D15/11 |

* cited by examiner

*Primary Examiner* — Thomas B Will
*Assistant Examiner* — Jamie L McGowan

(57) ABSTRACT

The surface rake apparatus provides for use either in forward or rearward motion, by virtue of the first member's forward wings and the second member's rearward wings. Debris such as snow, leaves, and limbs, for example, can thereby be easily channeled toward a desired destination. Snow, for example, can be pushed or pulled off of a roof or other surface. An important feature of the rearward wings of the second member is the upward slant of each. Another important feature is the inclusion of wheels on the first member. The wheels ensure against scraping by elevating the lower edges of the first and second members slightly above the surface to be rid of debris. The telescopic handle provides benefit of length adjustment so that the apparatus may be most conveniently used in reaching distant surfaces and also in reduced length for those areas more proximal to the user.

3 Claims, 3 Drawing Sheets

FIG. 1
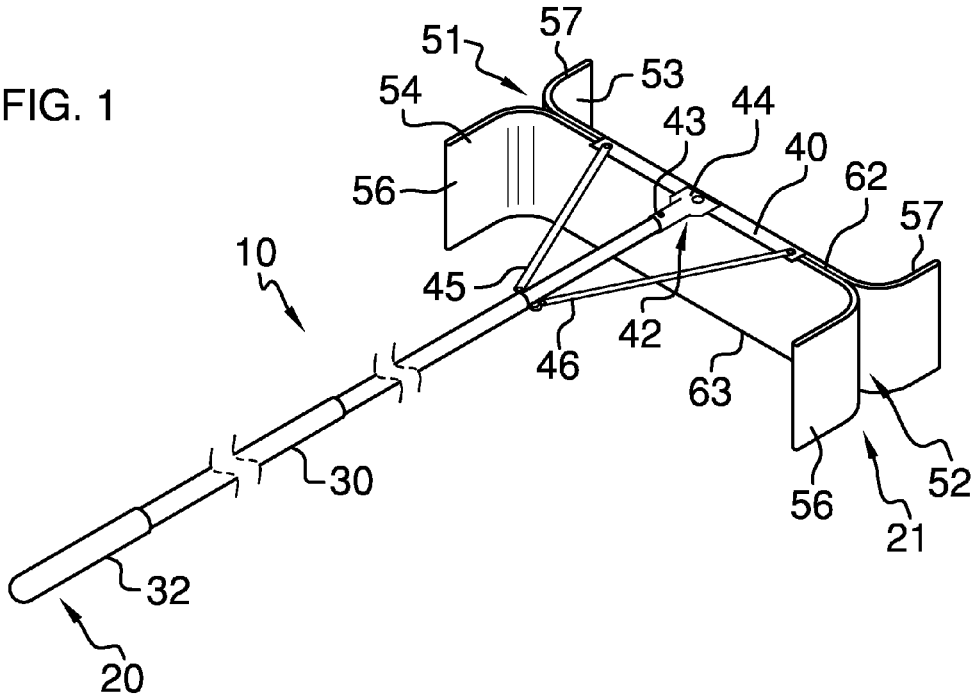
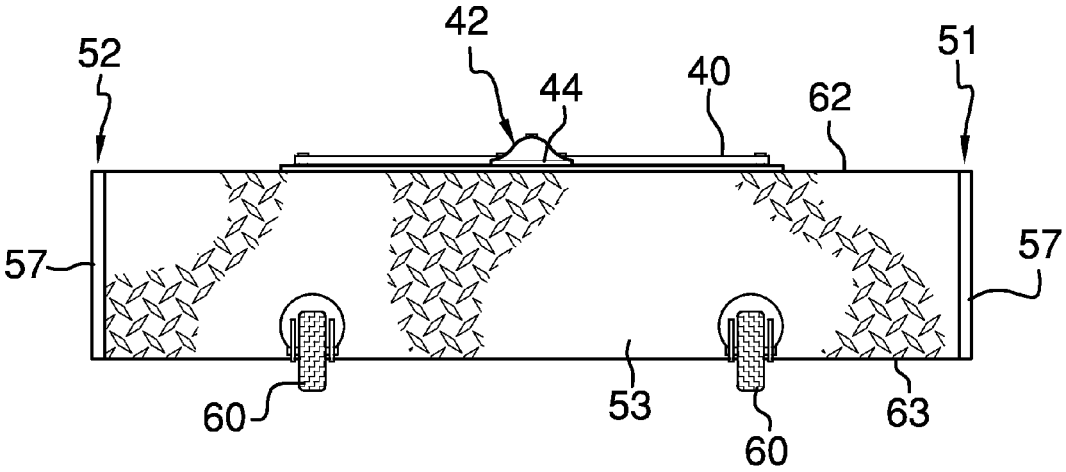
FIG. 2

SURFACE RAKE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various rake devices have been presented in the art, and many are designed to be especially effective in snow removal. Of the existing devices, some even feature wheels that assist in negating surface damage. The present apparatus provides unique features in a surface rake that is useful for snow removal as well as other tasks.

FIELD OF THE INVENTION

The surface rake apparatus relates to rakes and more especially to a rake apparatus that is effective for removing debris, such as snow for example, from a given surface.

SUMMARY OF THE INVENTION

The general purpose of the surface rake apparatus, described subsequently in greater detail, is to provide a surface rake apparatus which has many novel features that result in an improved surface rake apparatus which is not anticipated, rendered obvious, suggested, or even implied by prior art, either alone or in combination thereof.

To attain this, the surface rake apparatus provides for use either in forward or rearward motion, by virtue of the first member's forward wings and the second member's rearward wings. Debris such as snow, leaves, and limbs, for example, can thereby be easily channeled toward a desired destination. Snow, for example, can be pushed or pulled off of a roof or other surface. An important feature of the rearward wings of the second member is the upward slant of each. This may be an especially useful feature, for example, when a user is pulling snow from a roof and cannot ensure that the telescopic pole is parallel with the roof surface. Another important feature is the inclusion of wheels on the first member. Many surfaces, such as roofs and pool covers, for example, can be damaged by a device that merely scrapes away debris. The wheels ensure against scraping by elevating the lower edges of the first and second members slightly above the surface to be rid of debris. The telescopic handle provides obvious benefit in adjustment so that the apparatus may be most conveniently used in reaching distant surfaces and also in reduced length for those areas more proximal to the user.

Thus has been broadly outlined the more important features of the improved surface rake apparatus so that the detailed description thereof that follows may be better understood and in order that the present contribution to the art may be better appreciated.

An object of the surface rake apparatus is to provide for debris removal from a given surface.

Another object of the surface rake apparatus is to assist in preventing debris spillage beyond the first sides and second sides of the members of the apparatus.

A further object of the surface rake apparatus is to provide for using the apparatus both in forward and in rearward motion.

An added object of the surface rake apparatus to negate surface damage in apparatus use.

And, an object of the surface rake apparatus is to provide a telescopic pole.

These together with additional objects, features and advantages of the improved surface rake apparatus will be readily apparent to those of ordinary skill in the art upon reading the following detailed description of presently preferred, but nonetheless illustrative, embodiments of the improved surface rake apparatus when taken in conjunction with the accompanying drawings.

BRIEF DESCRIPTION OF THE DRAWINGS

FIG. 1 is an upper edge biased perspective view.
FIG. 2 is a front elevation view.

DETAILED DESCRIPTION OF THE DRAWINGS

Figure 3:
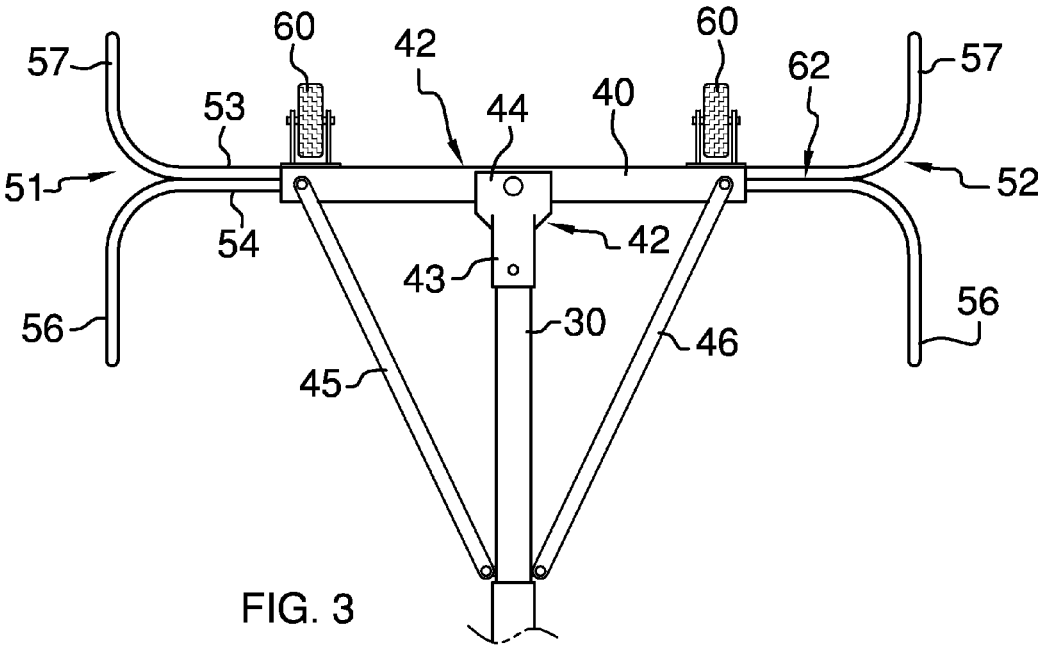
FIG. 3 is a partial top plan view.

With reference now to the drawings, and in particular FIGS. 1 through 5 thereof, the principles and concepts of the surface rake apparatus generally designated by the reference number 10 will be described.

Referring to FIG. 1, the apparatus 10 partially comprises a first end 20 spaced apart from a second end 21. The telescopic pole 30 is extended from the first end 20 to proximal to the second end 21.

Referring to FIG. 3, the connector 42 is disposed on the telescopic pole 30 second end 21. The connector 42 sleeve 43 is affixed around the telescopic pole 30. The connector 42 flange 44 is affixed to the connection plate 40. The pair of members is disposed back to back and perpendicularly to the telescopic pole 30 second end 21. The members comprise the first member 53 disposed forwardly and the second member 54 disposed behind the first member 53. The connection plate 40 assists in joining the members solidly. The first angled support 45 is disposed in mirror image fashion with the second angled support 46. One of each of the supports is affixed outwardly and oppositely to the connection plate 40 and also to an either side of the telescopic pole 30.

Referring to FIG. 2, each member has an upper edge 62 and a lower edge 63. Each member has a first side 51 spaced apart from a second side 52. A pair of forward wings 57 is disposed on the first member 53. One of each forward wing 57 partially comprises one of each of the first member 53 sides. The forward wings 57 are parallel to the telescopic pole 30. The pair of rearward wings 56 is disposed on the second member 54. One of each rearward wing 56 partially comprises one of each of the second member 54 sides. The rearward wings 56 are parallel to the telescopic pole 30.

Figure 4:
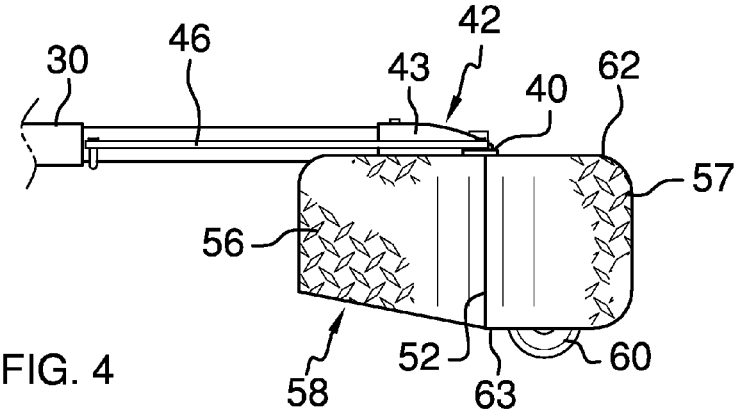
FIG. 4 is a lateral elevation view.

Referring to FIG. 4, an upward slant 58 is disposed rearwardly on each rearward wing 56 lower edge 63.

Referring again to FIGS. 3 and 4, the connection plate 40 is centrally disposed in joining the upper edges 62 of the members.

Referring to FIGS. 2 and 4, the pair of identical spaced apart wheels 60 is affixed forwardly and downwardly to the first member 53. The wheels 60 extend slightly downward from the lower edge 63.

Figure 5:
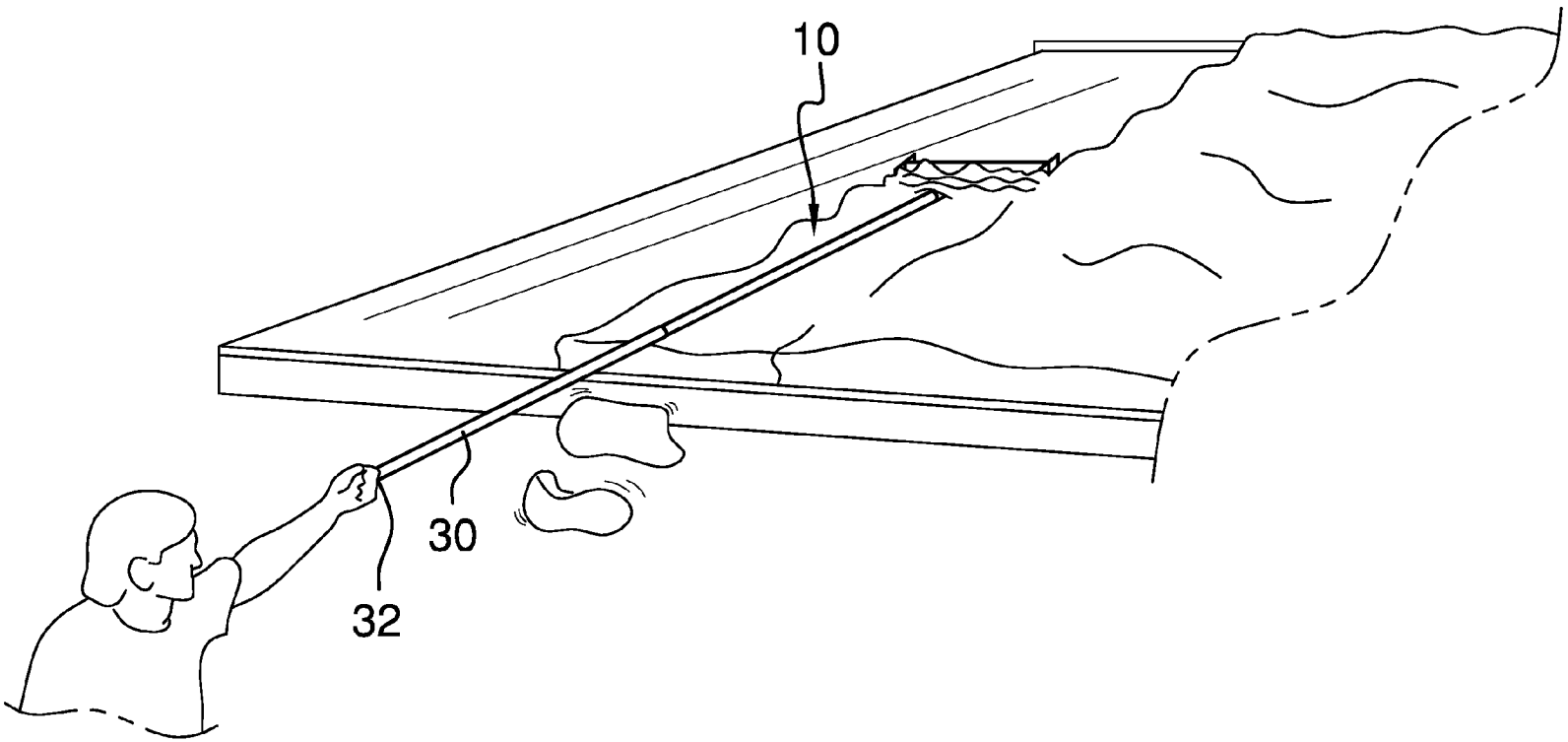
FIG. 5 is a perspective view in use.

In FIG. 5, the user grasps the handle 32 to pull snow off of a rooftop. The snow is corralled between the rearward wings 56 of the second member 54.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the surface rake apparatus may be used.

What is claimed is:

1. A surface rake apparatus comprising, in combination:

a first end spaced apart from a second end;

a telescopic pole extended from the first end to proximal to the second end;

a grip disposed on the first end;

a connector disposed on the second end;

a pair of members disposed back to back and perpendicularly to the telescopic pole, the members comprising a first member disposed forwardly and a second member disposed behind the first member, each member having an upper edge and a lower edge, each member having a first side spaced apart from a second side;

a pair of forward wings, one of each forward wing partially comprising one of each of the first member sides, the forward wings parallel to the telescopic pole;

a pair of rearward wings, one of each rearward wing partially comprising one of each of the second member sides, the rearward wings parallel to the telescopic pole;

a connection plate centrally joining the upper edges of the members;

a pair of identical spaced apart wheels affixed forwardly and downwardly to the first member, the wheels extended slightly downward from the lower edge.

2. A surface rake apparatus comprising, in combination:

a first end spaced apart from a second end;

a telescopic pole extended from the first end to proximal to the second end;

a grip disposed on the first end;

a connector disposed on the second end, the connector comprising a sleeve fitted around the telescopic pole and a forwardly disposed flange;

a pair of members disposed back to back and perpendicularly to the telescopic pole, the members comprising a first member disposed forwardly and a second member disposed behind the first member, each member having an upper edge and a lower edge, each member having a first side spaced apart from a second side;

a pair of forward wings, one of each forward wing partially comprising one of each of the first member sides, the forward wings parallel to the telescopic pole;

a pair of rearward wings, one of each rearward wing partially comprising one of each of the second member sides, the rearward wings parallel to the telescopic pole;

an upward slant disposed rearwardly on each rearward wing lower edge;

a connection plate centrally joining the upper edges of the members, the connector flange affixed to the connection plate;

a pair of identical spaced apart wheels affixed forwardly and downwardly to the first member, the wheels extended slightly downward from the lower edge.

3. A surface rake apparatus comprising, in combination:

a first end spaced apart from a second end;

a telescopic pole extended from the first end to proximal to the second end;

a grip disposed on the first end;

a connector disposed on the second end, the connector comprising a sleeve fitted around the telescopic pole and a forwardly disposed flange;

a pair of members disposed back to back and perpendicularly to the telescopic pole, the members comprising a first member disposed forwardly and a second member disposed behind the first member, each member having an upper edge and a lower edge, each member having a first side spaced apart from a second side;

a pair of forward wings, one of each forward wing partially comprising one of each of the first member sides, the forward wings parallel to the telescopic pole;

a pair of rearward wings, one of each rearward wing partially comprising one of each of the second member sides, the rearward wings parallel to the telescopic pole;

an upward slant disposed rearwardly on each rearward wing lower edge;

a connection plate centrally joining the upper edges of the members, the connector flange affixed to the connection plate;

a first angled support disposed in mirror image fashion with a second angled support, one of each of the supports affixed outwardly and oppositely to the connection plate and to an either side of the telescopic pole;

a pair of identical spaced apart wheels affixed forwardly and downwardly to the first member, the wheels extended slightly downward from the lower edge.

* * * * *